US006750612B2

(12) United States Patent
Takagaki et al.

(10) Patent No.: US 6,750,612 B2
(45) Date of Patent: Jun. 15, 2004

(54) MERCURY-FREE ARC TUBE FOR DISCHARGE LAMP UNIT

(75) Inventors: Michio Takagaki, Shizuoka (JP); Masaya Shido, Shizuoka (JP); Shinichi Irisawa, Shizuoka (JP); Takeshi Fukuyo, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/246,420

(22) Filed: Sep. 19, 2002

(65) Prior Publication Data

US 2003/0052610 A1 Mar. 20, 2003

(30) Foreign Application Priority Data

Sep. 20, 2001 (JP) ..... 2001-286252
Aug. 23, 2002 (JP) ..... 2002-243489

(51) Int. Cl.[7] ..... H01J 17/16; H01J 61/30

(52) U.S. Cl. ..... 313/634; 313/637; 313/573; 313/493

(58) Field of Search ..... 313/634, 493, 313/573, 24, 25, 26

(56) References Cited

U.S. PATENT DOCUMENTS 3,870,919 A * 3/1975 Hellman et al. ..... 313/623
4,468,590 A * 8/1984 Akutsu et al. ..... 313/634
4,594,529 A 6/1986 de Vrijer
4,935,668 A * 6/1990 Hansler et al. ..... 313/634
5,402,037 A 3/1995 Irisawa et al.
5,757,110 A * 5/1998 Motiduki et al. ..... 313/25
6,169,367 B1 * 1/2001 Muto et al. ..... 313/634
6,294,861 B1 9/2001 Mochiduki et al.
6,624,580 B2 * 9/2003 Kanegae et al. ..... 313/26

FOREIGN PATENT DOCUMENTS

EP 1063681 A2 * 12/2000 ..... H01J/61/12

* cited by examiner

*Primary Examiner*—Nimeshkumar D. Patel
*Assistant Examiner*—Mariceli Santiago
(74) *Attorney, Agent, or Firm*—Sughrue Mion, PLLC

(57) ABSTRACT

A mercury-free arc tube includes a closed glass bulb held between pinch seal portions located at opposite ends of the close glass bulb; and a pair of electrodes provided in the closed glass bulb so as to be opposite to each other. The closed glass bulb does not contain mercury but contains main light emitting metal halide (NaI and $ScI_3$). A rare gas is enclosed in the closed glass bulb with a charged pressure set to be in a range of from 8 to 20 atmospheres. If necessary, a predetermined buffer metal halide acting as a buffer substance is enclosed in the closed glass bulb. The charged pressure of the rare gas is higher than the conventional charged pressure (6 atmospheres).

9 Claims, 5 Drawing Sheets

FIG. 2

CORRELATION BETWEEN INNER DIAMETER RATIO OF CLOSED GLASS BULB AND CHARACTERISTICS OF ARC TUBE (n = 5 FOR EACH KIND)

| $D_2/D_1$ | 0.4 | 0.5 | 0.6 | 0.7 | 0.8 | 0.9 | 1.0 | 1.1 | 1.2 |
|---|---|---|---|---|---|---|---|---|---|
| SHAPE OF ARC | 3/5 △ | 5/5 ○ | 5/5 ○ | 5/5 ○ | 5/5 ○ | 5/5 ○ | 5/5 ○ | 3/5 △ | 0/5 × |
| STABILITY OF DISCHARGE | 1/5 × | 4/5 △ | 5/5 ○ | 5/5 ○ | 5/5 ○ | 5/5 ○ | 5/5 ○ | 4/5 △ | 4/5 △ |
| DEVITRIFICATION OF LIGHT EMITTING TUBE | 0/5 × | 3/5 △ | 5/5 ○ | 5/5 ○ | 5/5 ○ | 5/5 ○ | 5/5 ○ | 5/5 ○ | 5/5 ○ |
| RE-FIRING VOLTAGE | 1/5 × | 3/5 △ | 5/5 ○ | 5/5 ○ | 5/5 ○ | 5/5 ○ | 5/5 ○ | 5/5 ○ | 5/5 ○ |

MERCURY-FREE ARC TUBE FOR DISCHARGE LAMP UNIT

BACKGROUND OF THE INVENTION

1. Field of the Invention

The present invention relates to an arc tube for a discharge lamp unit, having a closed glass bulb held between pinch seal portions located at opposite ends of the closed glass bulb, and a pair of electrodes provided in the closed glass bulb so as to be opposite to each other. Particularly it relates to a mercury-free arc tube for a discharge lamp unit, having a closed glass bulb not containing mercury but containing main light emitting metal halide and starting rare gas enclosed in the closed glass bulb.

2. Description of the Related Art

FIG. 4 shows a discharge bulb which is a conventional discharge lamp unit used as a light source of an automotive lamp. The discharge bulb has a structure in which an arc tube 2 having a closed glass bulb 2*a* as a light emitting portion is integrated with an electrically insulating plug body 1 made of a synthetic resin. A rear end portion of the arc tube 2 is gripped by a metal support member 8 fixed to the electrically insulating plug body 1. A front end portion of the arc tube 2 is supported by a metal lead support 9 which serves also as a current conduction path extended out from the electrically insulating plug body 1.

The arc tube 2 has a structure in which main light emitting metal halide, buffer mercury and starting rare gas are enclosed in the closed glass bulb 2*a* which is held between pinch seal portions 2*b* and 2*b* located at opposite ends of the close glass bulb 2*a* and which is provided with a pair of electrodes 3 and 3 so as to be opposite to each other. Light is emitted on the basis of arc generated by electric discharge between the pair of electrodes 3 and 3. The discharge bulb is superior to that of an incandescent bulb because a large quantity of emitted light, a long lifetime, etc. can be achieved by the discharge bulb. For this reason, nowadays there is a tendency for the discharge bulb to be used as a light source for a head lamp or a fog lamp.

The reference numeral 4 designates a lead wire led out from each pinch seal portion 2*b*. The reference numeral 5 designates a sheet of molybdenum foil for connecting the lead wire 4 to a corresponding tungsten electrode 3. Further, ultraviolet-shielding shroud glass 6 is integrally welded to the arc tube 2 to thereby form a structure in which the closed glass bulb 2*a* is surrounded by a closed space formed by the shroud glass 6. Hence, the closed glass bulb 2*a* is kept at a high temperature while ultraviolet rays in a wavelength range harmful to the human body are cut off from light emitted from the arc tube 2.

Mercury enclosed in the conventional closed glass bulb 2*a* is a substance toxic to the environment. In response to the social needs of reducing the cause of global environmental pollution as much as possible, it is desirable that a mercury-free arc tube not containing mercury, which is a substance toxic to the environmental, is developed.

SUMMARY OF THE INVENTION

The following findings have been obtained in the process of research and development on a mercury-free arc tube not containing mercury.

Mercury acts mainly as buffer substance for keeping the tube voltage constant to reduce the amount of electrons colliding with electrodes to thereby buffer the damage of is the electrodes. Mercury acts also as a light emitting substance for emitting white light. For this reason, if mercury was removed from the substances enclosed in the closed glass bulb, the following changes (problems) occurred in the characteristic as the arc tube.

Firstly, the tube voltage is reduced. That is, because the tube electric power required for electric discharge cannot be obtained, it is necessary to increase the tube current in order to increase the tube electric power. Hence, the load imposed on the electrodes increases, so that luminous efficacy is lowered. Moreover, the amount of heat generated in ballast increases because of the increase of the tube current, so that system efficiency is lowered.

Secondly, the rising edge of luminous flux is delayed. That is, a sufficient quantity of emitted light cannot be obtained at an initial stage of operation (electric discharge) because mercury high in vapor pressure is absent.

Thirdly, luminous flux in a visible region is reduced because light emitted due to mercury is absent.

Fourthly, the color of emitted light is different (reddish) from the color of light emitted from the conventional mercury-containing arc tube.

Fifthly, luminous intensity distribution control can be hardly performed because the curvature of arc generated by electric discharge between the electrodes is large.

The spectral characteristic of a mercury-free arc tube having main light emitting metal halide (NaI and $ScI_3$) and a rare gas enclosed in a closed glass bulb was as represented by the solid line in FIG. 5. It has been found that the mercury-free arc tube generally exhibits substantially the same spectral characteristic as that of the conventional mercury-containing arc tube except that the intensity of light particularly in wavelength ranges near to 435 nm and 546 nm in the mercury-free arc tube is lower (lower in peak) by the quantity represented by the broken line in FIG. 5 than that in the conventional mercury-containing arc tube.

Therefore, experiments have been performed to examine whether characteristics approaching the characteristics of the conventional mercury-containing arc tube can be obtained or not. The experiments are directed to a selection of metal halide to be enclosed, which has a buffer function and is effective in increasing the intensity of light in wavelength ranges near to 435 nm and 546 nm in spectral characteristic. Such metal halide should be selected as a substitute of mercury having a buffer function and be enclosed while the charged pressure of a rare gas enclosed in the closed glass bulb and a quantity and ratio of enclosure of the main light emitting metal halide are adjusted without changing the shape and dimensions of the conventional mercury-containing arc tube as possible. As a result, it has been confirmed that the characteristic can be improved. Thus, Japanese patent application No. 2001-286252 is proposed (applied).

After then, as a result of continuous experiments by the inventors, it is confirmed that there can be provided a mercury-free arc tube which has characteristics approaching the characteristics of a conventional mercury-containing arc tube even if buffer metal halide is not enclosed in the closed glass bulb while a total amount and ratio of the main light emitting metal halide and the charged pressure of starting rare gas enclosed in the closed glass bulb are adjusted. Thus, Japanese patent application No. 2002-243489 is proposed (applied).

The present invention is based on the problems in the conventional art and the inventor's knowledge and an object thereof is to provide a mercury-free arc tube for a discharge lamp unit in which characteristics approaching the characteristics of the conventional arc tube can be obtained.

In order to achieve the object, according to a first aspect of the invention, there is provided a mercury-free arc tube, which is not containing mercury, for a discharge lamp unit, in which electrodes are opposite to each other and provided in a closed glass bulb held between pinch seal portions, and main light emitting metal halide is enclosed; wherein starting rare gas has a charged pressure set to be in a range of from 8 to 20 atmospheres.

Preferably, according to a second aspect of the invention, buffer metal halide is enclosed in the closed glass bulb together with the main light emitting metal halide and the starting rare gas.

(Operation) Substances used in the conventional case are used as the main light emitting metal halide and the starting rare gas. That is, sodium-scandium-based halide such as NaI and $ScI_3$ is used as the former and Xe is used as the latter.

The buffer metal halide in place of mercury is at least one selected from the group consisting of halides of Al, Bi, Cr, Cs, Fe, Ga, In, Mg, Ni, Nd, Sb, Sn, Tb, Tl, Ti, Li and Zn. When the buffer metal halide is enclosed in the closed glass bulb, great reduction of the tube voltage caused by no mercury enclosed can be suppressed.

Particularly when the charged pressure of the starting rare gas is set at a pressure (of 8 to 20 atmospheres), which is higher than the charged pressure (of 3 to 6 atmospheres) in the conventional arc tube, the ratio at which electrons released from the electrodes at electric discharge collide with molecules of the rare gas is increased to raise the temperature of the inside of the closed glass bulb in operation (at electric discharge). Accordingly, the vapor pressure of the main light emitting metal halide (as for the second aspect of the invention, the main light emitting metal halide and the buffer metal halide) is increased to thereby increase the tube voltage. Hence, it is unnecessary to significantly increase the tube current, and there is no possibility that the load imposed on the electrodes may significantly increase because of the increase of the tube current. As a result, there is no fear that luminous efficacy may be significantly lowered, and there is no significant increase in the amount of heat generated in ballast because of the increase of the tube current, there is no significant lowering of system efficiency. That is, contribution to solution of the first problem (reduction of tube voltage) is achieved.

When at least one kind of metal halide which generates an emission color close to the emission color of mercury and which is selected from the group consisting of halides of Al, Bi, Cr, Cs, Fe, Ga, In, Mg, Ni, Nd, Sb, Sn, Tb, Tl, Ti, Li and Zn is enclosed in the closed glass bulb, the enclosure compensates for reduction in the quantity of emitted (white) light in a visible region and reduction in the luminous flux. Particularly because the charged pressure of the starting rare gas is high (8 to 20 atmospheres), the temperature of the inside of the closed glass bulb in operation (at electric discharge) is made high as described above. Hence, the vapor pressure of the buffer metal halide is increased and the intensity of light in wavelength ranges near 435 nm and/or 546 nm is increased, so that substantially the same quantity of emitted light as that of light emitted from the conventional arc tube can be obtained when the color of emitted light is white which is substantially the same as the color of light emitted from the conventional arc tube.

Further, as mentioned in the first aspect of the invention, even if the buffer metal halide is not enclosed, the vapor pressure of the main light emitting metal halide, whose quantity and/or ratio of enclosure is adjusted, is increased. Hence, substantially the same quantity of emitted light as that of light emitted from the conventional arc tube can be obtained when the color of emitted light is white which is substantially the same as the color of light emitted from the conventional arc tube.

That is, contribution to solution of the third and fourth problems (reduction in luminous flux and color of emitted light) is achieved.

Because the charged pressure of the starting rare gas is high, the temperature of the inside of the closed glass bulb in operation (at electric discharge) is made high as described above. Hence, the vapor pressure of the main light emitting metal halide (sodium-scandium-based halide such as NaI and $ScI_3$) is increased, so that the luminous flux is increased. That is, contribution to solution of the third problem (reduction in luminous flux) is achieved.

When the charged pressure of the rare gas is high, the DC resistance component (impedance) at starting is increased. Hence, the consumed electric power is increased, so that the temperature of the closed glass bulb in operation (at electric discharge) rises rapidly. That is, contribution to solution of the second problem (rising edge of luminous flux) is achieved.

Moreover, the center temperature of the arc in the closed glass bulb rises, so that the center luminance of the arc increases. That is, contribution to solution of the third problem (reduction in luminous flux) is achieved.

According to a third object of the invention, there is provided a mercury-free arc tube for a discharge lamp unit, as described in the first or second aspect of the invention, in which a ratio (D2/D1) of an inner diameter D2 (mm) at a position near a tip end portion of the electrode to an inner diameter D1 (mm) at a position in the middle of the electrodes of the closed glass bulb is in a range of from 0.5 to 1.1, preferably, from 0.6 to 1.0.

(Operation) According to the experiments by the inventors, it is confirmed, as shown in FIG. 2, that the ratio (D2/D1) of an inner diameter D2 (mm) at a position near a tip end portion of the electrode to an inner diameter D1 (mm) at a position in the middle of the electrodes of the closed glass bulb affects a shape of an arc, stability of discharge, a devitrification phenomenon and re-firing voltage in the closed glass bulb. Further, it is confirmed that D2/D1 should be in a range of from 0.4 to 1.1 for appropriateness of the shape of the arc (linearity of the arc), that D2/D1 should be in a range of from 0.5 to 1.2 for the stability of discharge (stable discharge without blink), that D2/D1 should be 0.5 or more for avoiding the devitrification phenomenon of the closed glass bulb, and that D2/D1 should be 0.5 or more for appropriateness of re-firing voltage. Hence, it is preferable that D2/D1 should be in a range of from 0.5 to 1.1, more preferably in a range of from 0.6 to 1.0, in order to satisfy all conditions for the appropriate shape of the arc, the stability of discharge, the avoidance of the devitrification phenomenon and the appropriate refiring voltage.

According to a fourth aspect of the invention, the mercury-free arc tube for the discharge lamp unit, mentioned in one of the first to third aspects of the invention, is constituted such that the closed glass bulb has a maximum inner diameter in a range of from 2.0 to 3.5 mm; a distance between the electrodes is in a range of from 4.0 to 4.4 mm; a length of protrusion of the electrode into the closed glass bulb is in a range of from 1.0 to 2.0 mm; and a quantity of enclosure of the main light emitting metal halide is in a range of from 0.1 to 0.6 mg.

(Operation) The distance between the electrodes is set to be in a range of from 4.0 to 4.4 mm to satisfy ECE standards, like the conventional case. The length of protrusion of the electrode into the closed glass bulb is set at a dimension ranging from 1.0 to 2.0 mm but slightly smaller than the conventional length (1.8 to 2.0 mm) of protrusion. The axial length of the inside of the closed glass bulb is formed to be not larger than the axial length of the inside of the conventional closed glass bulb. In addition, the maximum inner diameter of the closed glass bulb is set to be in a range of from 2.0 to 3.5 mm and slightly smaller than the maximum inner diameter of the conventional closed glass bulb. Hence, the vapor pressure of the main light emitting metal halide in the closed glass bulb is made high in accordance with reduction in volume of the closed glass bulb, so that the luminous flux increases. Moreover, the heat capacity of the closed glass bulb is made low in accordance with reduction in volume of the closed glass bulb, so that the temperature of the inside of the closed glass bulb at starting rises rapidly. That is, contribution to solution of the second problem (rising edge of luminous flux) is achieved. Incidentally, the amount of enclosure of the main light emitting metal halide is preferably in a range of from 0.1 to 0.6 mg having enlarged upper and lower limits compared with the range of from 0.2 to 0.4 mg as the amount of enclosure in the conventional mercury-containing arc tube.

Moreover, the inside of the closed glass bulb is narrowed in the direction of the radius thereof so that the curvature of the inner circumferential surface of the closed glass bulb surrounding the inter-electrode region in which an arc is generated is reduced. In accordance with this reduction, the curvature of the arc is reduced and the arc size is reduced. As a result, luminous intensity distribution control of the arc can be made easily. That is, contribution to solution of the fifth problem (curvature of arc) is achieved.

While the distance between the electrodes is set to be in a range of from 4.0 to 4.4 mm to satisfy ECE standards, the length of protrusion of each of the electrodes into the closed glass bulb is set to be in a range of from 1.0 to 2.0 mm and slightly smaller than the conventional length (1.8 to 2.0 mm) of protrusion. Hence, condensation of the main light emitting metal halide (NaI, $ScI_3$) onto the base of each of the electrodes is avoided so that a predetermined chromaticity is obtained. That is, contribution to solution of the fourth problem (color of emitted light) is achieved.

In this manner, a mercury-free arc tube having the shape and dimensions similar to those of the conventional mercury-containing arc tube and having characteristics substantially equivalent to the characteristics of the conventional mercury-containing arc tube can be produced.

According to a fifth aspect of the invention, in the mercury-free arc tube for the discharge lamp unit stated in one of the first to fourth aspects of the invention, cylindrical shroud glass is integrally welded to the arc tube to thereby form a closed space surrounding the closed glass bulb, and an inert gas with a pressure not higher than 1 atmosphere is enclosed in the closed space.

(Operation) Because the molecular density of the inert gas enclosed in the closed space surrounding the closed glass bulb is low, heat transfer between the closed glass bulb and the shroud glass through the closed space is suppressed. For this reason, heat in the closed glass bulb hardly goes to the outside, so that the temperature of the inside of the closed glass bulb is kept high. Hence, the vapor pressures of the main light emitting metal halide, the buffer metal halide and the rare gas in the closed glass bulb are made high, so that the tube voltage increases to thereby improve the first problem (reduction of tube voltage). Moreover, the vapor pressure of the main light emitting metal halide in the closed glass bulb is made high, so that the luminous flux increases to thereby improve the third problem (reduction in luminous flux). Moreover, at an initial stage of operation (electric discharge), the temperature of the inside of the closed glass bulb is raised rapidly to thereby make the vapor pressure of the main light emitting metal halide high. That is, the second problem (rising edge of luminous flux) is improved.

BRIEF DESCRIPTION OF THE DRAWINGS

FIG. 2 is a graph showing the correlation between the inner diameter ratio D2/D1 of the closed glass bulb and the shape of arc, the stability of the discharge, the devitrification phenomenon or the re-firing voltage in the closed glass bulb.

DETAILED DESCRIPTION OF THE PREFERRED EMBODIMENTS

A mode for carrying out the present invention will be described below on the basis of embodiments thereof.

Figure 1:
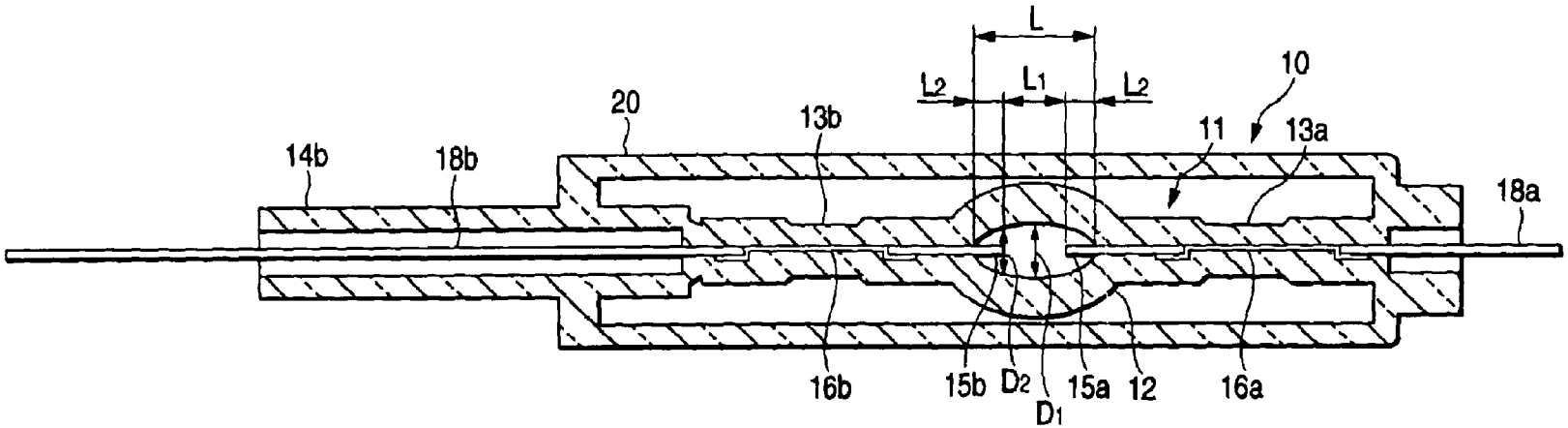
FIG. 1 is a vertical sectional view of a mercury-free arc tube for a discharge lamp unit as a first embodiment of the present invention.

FIG. 1 is a vertical sectional view of a mercury-free arc tube for a discharge lamp unit showing a first embodiment of the present invention.

In this drawing, the arc tube 10 has a structure in which cylindrical ultraviolet-shielding shroud glass 20 is integrally welded (sealed) to an arc tube body 11 having a closed glass bulb 12 provided with a pair of electrodes 15*a* and 15*b* opposite to each other so that the closed glass bulb 12 is surrounded by and sealed with the ultraviolet-shielding shroud glass 20.

The arc tube body 11 is processed from a circular pipe-shaped silica glass tube and has a structure in which the closed glass bulb 12 shaped like a rotary spheroid is formed in a predetermined lengthwise position so as to be held between pinch seal portions 13*a* and 13*b* each shaped like a rectangle in cross section. Rectangular sheets of molybdenum foil 16*a* and 16*b* are sealed at the pinch seal portions 13*a* and 13*b*, respectively. Tungsten electrodes 15*a* and 15*b* are provided in the closed glass bulb 12 so as to be opposite to each other. While the tungsten electrodes 15*a* and 15*b* are connected to one sides of the sheets of molybdenum foil 16*a* and 16*b* respectively, lead wires 18*a* and 18*b* led out of the arc tube body 11 are connected to the other sides of the sheets of molybdenum foil 16*a* and 16*b* respectively.

The cylindrical ultraviolet-shielding shroud glass 20 having an aperture larger than that of the closed glass bulb 12 is integrally welded to the arc tube body 11, so that a region of from the pinch seal portions 13*a* and 13*b* of the arc tube body 11 to the closed glass bulb 12 is surrounded by and sealed with the ultraviolet-shielding shroud glass 20 while a circular pipe-shaped rear extended portion 14*b* which is a non-pinch seal portion of the arc tube body 11 is protruded to the rear of the shroud glass 20. The shroud glass 20 is constituted by silica glass doped with $TiO_2$ and $CeO_2$ and the like and exhibiting an ultraviolet-shielding function. The shroud glass 20 is provided for surely cutting off ultraviolet rays in a predetermined wavelength range harmful to the human body from light emitted from the closed glass bulb 12 which is an electric discharge portion.

Starting rare gas, main light emitting metal halide and buffer metal halide substituted for mercury which is a conventional buffer substance are enclosed in the glass bulb 12. The charged pressure of the starting rare gas (Xe) is set to be in a range of from 8 to 20 atmospheres. Thus, a mercury-free arc tube exhibiting characteristics substantially equivalent to the characteristics of the conventional mercury-containing arc tube is formed.

That is, the main light emitting metal halide is a substance such as NaI and $ScI_3$ mainly contributing to light emission. The buffer metal halide is constituted by at least one kind of metal halide selected from the group consisting of halides of Al, Bi, Cr, Cs, Fe, Ga, In, Mg, Ni, Nd, Sb, Sn, Tb, Tl, Ti, Li and Zn. The buffer metal halide acts as a buffer substance for suppressing great reduction of the tube voltage instead of mercury enclosed in the conventional arc tube and acts also as a light emitting substance substituted for mercury.

Further, a specific configuration of the mercury-free arc tube will be described. Incidentally, the term "conventional" used in the description means the case of a conventional mercury-containing arc tube.

Preferably, the maximum inner diameter D1 at a position in the middle of the pair of electrodes of the closed glass bulb 12 is relatively small compared with the conventional size to be in a range of from 2.0 to 3.5 mm. The distance L1 between the electrodes is substantially equal to the conventional distance to be in a range of from 4.0 to 4.4 mm. The length L2 of protrusion of the electrode into the closed glass bulb 12 is in a range of from 1.0 to 2.0 mm (whereas the conventional length is in a range of from 1.8 to 2.0 mm). A ratio D2/D1 of an inner diameter D2 at a position near a tip end portion of the electrode to the inner diameter D1 at the position in the middle of the electrodes of the closed glass bulb 12 is in a range of from 0.5 to 1.1. The amount of enclosure of the main light emitting metal halide is in a range of from 0.1 to 0.6 mg (whereas the conventional amount is in a range of from 0.2 to 0.4 mg). The amount of enclosure of the buffer metal halide is preferably in a range of from $3\times10^{-4}$ to $2\times10^{-2}$ mg/$\mu$l. The arc tube according to this embodiment shown in the drawing is formed so that the shape and dimensions of the arc tube are quite the same as those of the conventional mercury-containing arc tube or so that the arc tube has a slim closed glass bulb 12 with the inner diameter D1 at the position in the middle of the electrodes, which is not larger than the conventional size. Design is made such that an inert gas with a pressure not higher than 1 atmosphere (0.5 atmosphere in the conventional case) is further enclosed in the shroud glass 20 to thereby perform a heat insulating function against radiation of heat from the closed glass bulb 12 which is an electric discharge portion.

The buffer metal halide enclosed in the closed glass bulb 12 suppresses great reduction of the tube voltage caused by no mercury enclosed. Particularly because the charged pressure of the starting rare gas is a pressure (of 8 to 20 atmospheres) higher than the charged pressure (of 6 atmospheres) in the conventional arc tube, the ratio at which electrons released from the electrodes 15*a* and 15*b* at electric discharge collide with molecules of the rare gas increases. As a result, the temperature of the inside of the closed glass bulb 12 in operation (at electric discharge) becomes high, so that the vapor pressure of the main light emitting metal halide and the buffer metal halide is made high. As a result, the tube voltage increases to a value substantially equal to the tube voltage of the conventional mercury-containing arc tube.

The above-mentioned buffer metal halide generates an emission color close to the emission color of mercury and acts to compensate for reduction in the quantity of emitted (white) light in a visible region and reduction in the luminous flux caused by no mercury enclosed. Particularly because the charged pressure of the rare gas is high (8 to 20 atmospheres), the temperature of the inside of the closed glass bulb 12 in operation (at electric discharge) is made high as described above. As a result, the vapor pressure of the buffer metal halide is made high, so that substantially the same whiteness (chromaticity) as the color of light emitted from the conventional mercury-containing arc tube can be obtained.

Figure 5:
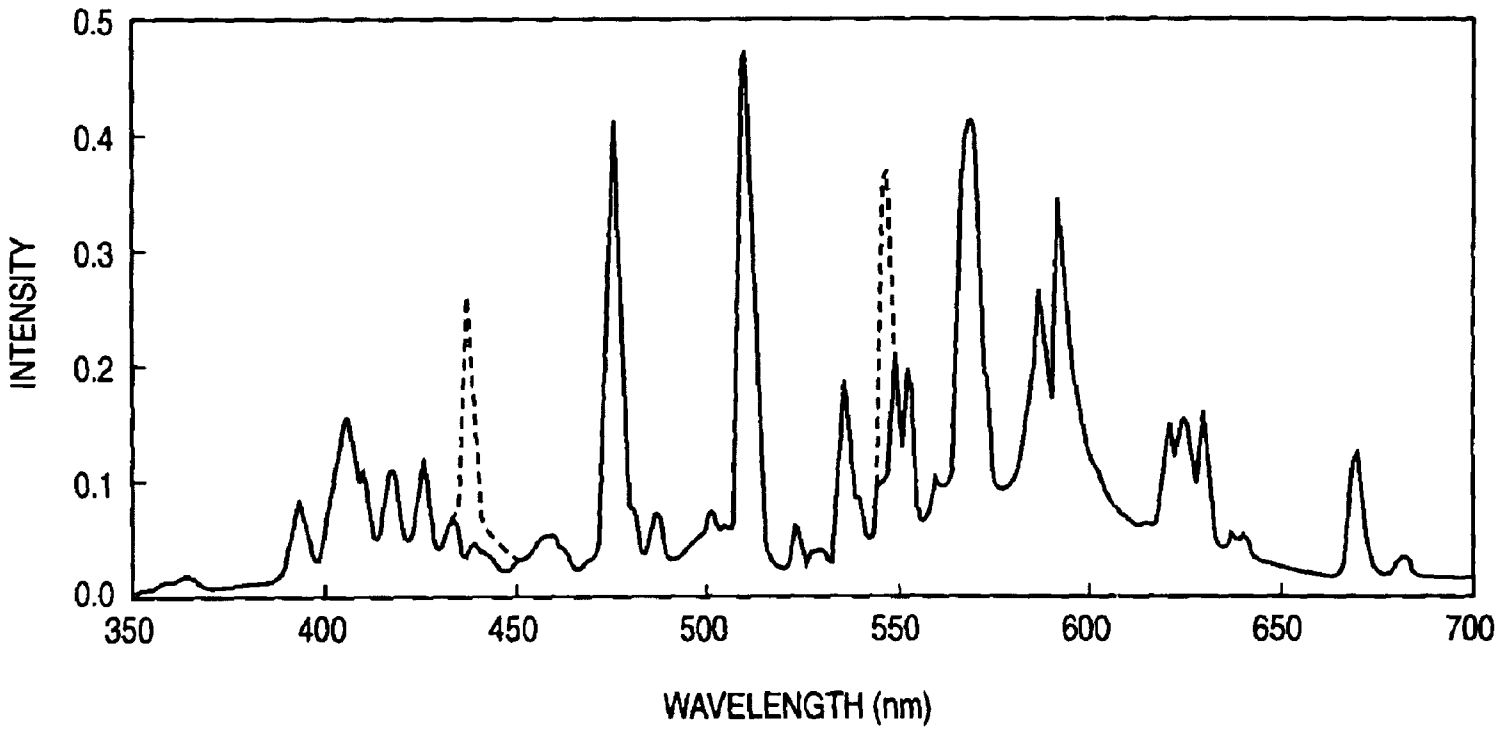
FIG. 5 is a spectral characteristic graph of a mercury-free arc tube in which mercury is not contained in the closed glass bulb but main light emitting metal halide (NaI and $ScI_3$) and a rare gas are enclosed in a closed glass bulb.

That is, the spectral characteristic of the mercury-free arc tube having no buffer metal halide enclosed makes a curve as represented by the solid line in FIG. 5. The spectral characteristic is short of intensity of light in wavelength ranges near to 435 nm and 546 nm compared with the spectral characteristic of the conventional mercury-containing arc tube. However, when the buffer metal halide is enclosed in the closed glass bulb 12 and the vapor pressure of the buffer metal halide is made high, substantially the same whiteness (chromaticity) as the color of light emitted from the conventional mercury-containing arc tube can be obtained because the intensity of light in wavelength ranges near to 435 nm and/or 546 nm increases to approach the intensity of light in wavelength ranges near to 435 nm and/or 546 nm in the spectral characteristic of the conventional mercury-containing arc tube (see the broken line in FIG. 5).

The amount of enclosure of the buffer metal halide used effectively to improve the tube voltage and the chromaticity and the like as described above is preferably in a range of from $3\times10^{-4}$ to $2\times10^{-2}$ mg/$\mu$l.

Because the charged pressure of the starting rare gas is high (8 to 20 atmospheres), the temperature of the inside of the closed glass bulb 12 in operation (at electric discharge) is made high as described above. As a result, the vapor pressure of the main light emitting metal halide (NaI and $ScI_3$) is made high, so that the luminous flux increases.

Because the charged pressure of the rare gas is high (8 to 20 atmospheres), the DC resistance component (impedance) at starting increases and the consumed electric power increases. As a result, the temperature of the closed glass bulb 12 in operation (at electric discharge) rises rapidly, so that the rising edge of luminous flux is made good. That is, predetermined luminous flux can be obtained in a short time after the start of electric discharge.

When the temperature of the inside of the closed glass bulb 12 is made high, the center temperature of the arc rises. As a result, the center luminance of the arc increases, so that the luminous flux increases.

Because the axial length L of the inside of the closed glass bulb 12 is set to be equal to or smaller than that of the conventional closed glass bulb and the inner diameter D1 at the position in the middle of the electrodes of the closed glass bulb 12 is set to be not larger than the maximum inner diameter of the conventional closed glass bulb, the vapor pressure of the main light emitting metal halide in the closed glass bulb 12 is increased in accordance with the reduction in volume of the closed glass bulb 12. As a result, the luminous flux increases. Moreover, the heat capacity of the closed glass bulb 12 decreases in accordance with the reduction in volume of the closed glass bulb 12, so that the temperature of the inside of the closed glass bulb 12 at starting rises rapidly. The amount of the main light emitting metal halide enclosed in the closed glass bulb 12 can effectively range from 0.1 to 0.6 mg having enlarged upper and lower limits compared with the conventional range of from 0.2 to 0.4 mg.

Moreover, the inside of the closed glass bulb 12 is narrowed in the direction of the radius thereof, so that the curvature of the inner circumferential surface of the closed glass bulb 12 surrounding the inter-electrode region in which an arc is generated is reduced. In accordance with this reduction, the curvature of the arc is reduced and the size of the arc is reduced. As a result, luminous intensity distribution control of the arc can be performed easily.

The distance L1 between the electrodes is set to be in a range of from 4.0 to 4.4 mm to satisfy ECE standards like the conventional case. When the length L2 of protrusion of the electrode into the closed glass bulb 12 is set at a dimension in a range (of from 1.0 to 2.0 mm) so as to be slightly smaller than the conventional length (1.8 to 2.0 mm) of protrusion, condensation of the main light emitting metal halide (NaI, $ScI_3$) onto the base of each of the electrodes can be avoided so that an appropriate chromaticity in an ECE standard range can be surely obtained.

The pressure of the inert gas in the closed space formed by the shroud glass 20 and surrounding the closed glass bulb 12 is not higher than 1 atmosphere (in this embodiment, the pressure is 0.5 atmosphere equal to the pressure in the conventional case). Because the molecular density of the insert gas is low, heat on the closed glass bulb 12 side hardly goes out of the shroud glass through the closed space (inert gas layer). As a result, the temperature of the inside of the closed glass bulb 12 can be kept high.

Accordingly, the vapor pressures of the main light emitting metal halide, the buffer metal halide and the rare gas in the closed glass bulb 12 in operation (at electric discharge) are made high, so that the tube voltage, the luminous flux, the rising edge of luminous flux, the chromaticity and so on are improved more. Thus, a mercury-free arc tube having characteristics approaching the characteristics of the conventional mercury-containing arc tube can be obtained.

Further, according to this embodiment, a ratio (D2/D1) of an inner diameter D2 at a position near a tip end portion of the electrode to an inner diameter D1 at a position in the middle of the electrodes of the closed glass bulb 12 is set in a range of from 0.5 to 1.1 as described above. As a result, the appropriate shape of the arc, the stability of the discharge, the avoidance of devitrification and the appropriate re-firing voltage in the closed glass bulb are satisfied.

FIG. 2 shows the correlation between the inner diameter ratio D2/D1 of the closed glass bulb 12 and the shape of arc, the stability of the discharge, the devitrification phenomenon or the re-firing voltage in the closed glass bulb. This figure shows results of experiments on mercury-free arc tubes according to the first embodiment and mercury-free arc tubes according to the second embodiment, which will be described later. In the figure, o, Δ and X designate that each characteristic described in the left column is satisfactory, almost satisfactory or insufficient, respectively. Incidentally, in arc tubes (closed glass tubes 12 of arc tubes) used for the experiments, 0.3 mg of NaI and $ScI_3$ (NaI:$ScI_3$=70:30 (wt %)), which are main light emitting metal halides, 0.05 mg of ZnI, which is buffer metal halide, and Xe gas (charged pressure thereof is 10 atmospheres) are enclosed.

As shown in FIG. 2, the inner diameter ratio D2/D1 of the closed glass bulb affects the shape of the arc, the stability of the discharge, the devitrification phenomenon and the re-firing voltage in the closed glass bulb. As for the shape of arc, the curvature of the arc becomes large when D2/D1 is less than 0.4, and a center portion of the arc in the longitudinal direction is caved inside when D2/D1 is 1.2 or more. For each of the cases, luminous intensity distribution control becomes difficult because the linearity of the arc is reduced. Hence, D2/D1 is preferably in a range of from 0.4 to 1.1 (more preferably, from 0.5 to 1.0).

As for the stability of the discharge, when D2/D1 is 0.4 or less, the temperature of the electrode is not increased sufficiently and emission of electrons from the electrode is reduced because a wall of the tube is too close to the electrode. As a result, the arc blinks. Hence, D2/D1 is preferably in a range of from 0.5 to 1.2 (more preferably, from 0.6 to 1.0).

Further, as for the devitrification phenomenon of the closed glass bulb, Sc reacts with the glass thereby turning the tube wall into white when D2/D1 is 0.4 or less. As a result, permeability of light is reduced. Hence, D2/D1 is preferably 0.5 or more (more preferably, 0.6 or more).

Moreover, as for the re-firing voltage, when D2/D1 is 0.4 or less, the temperature of the electrode is reduced while the polarity is switched because the tube wall is too close to the electrode. As a result, the re-firing voltage is increased, and the arc blinks. Hence, D2/D1 is preferably 0.5 or more (more preferably, 0.6 or more).

Considering the above, according to the present embodiment, D2/D1 is set in a range of from 0.5 to 1.1 so that the proper shape of the arc, the stability of the discharge, the avoidance of devitrification and the appropriate re-firing voltage in the closed glass bulb are satisfied.

Further, according to the mercury-free arc tubes of the first embodiment, which are used for the experiments shown in FIG. 2, the tube voltage is 42V, the luminous flux is 3,200 lumen, the chromaticity x is 0.385 and the chromaticity y is 0.390. Hence, the characteristics (tube voltage, luminous flux, chromaticity) close to those of the conventional mercury-containing arc tubes are obtained.

Figure 3:
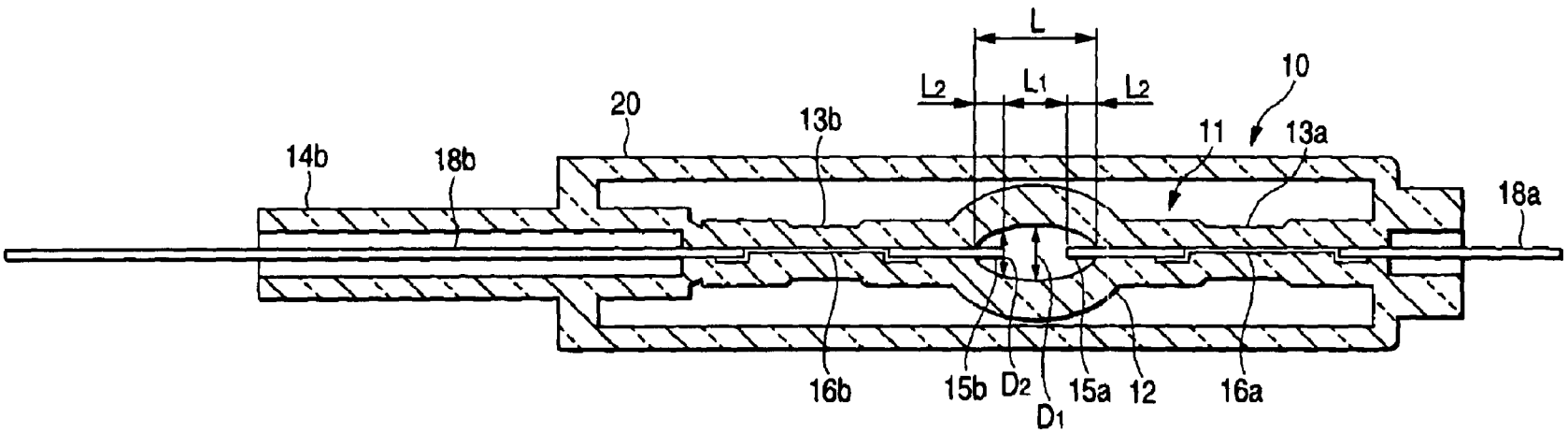
FIG. 3 is a vertical sectional view of a mercury-free arc tube for a discharge lamp unit as a second embodiment of the present invention.
Figure 4:
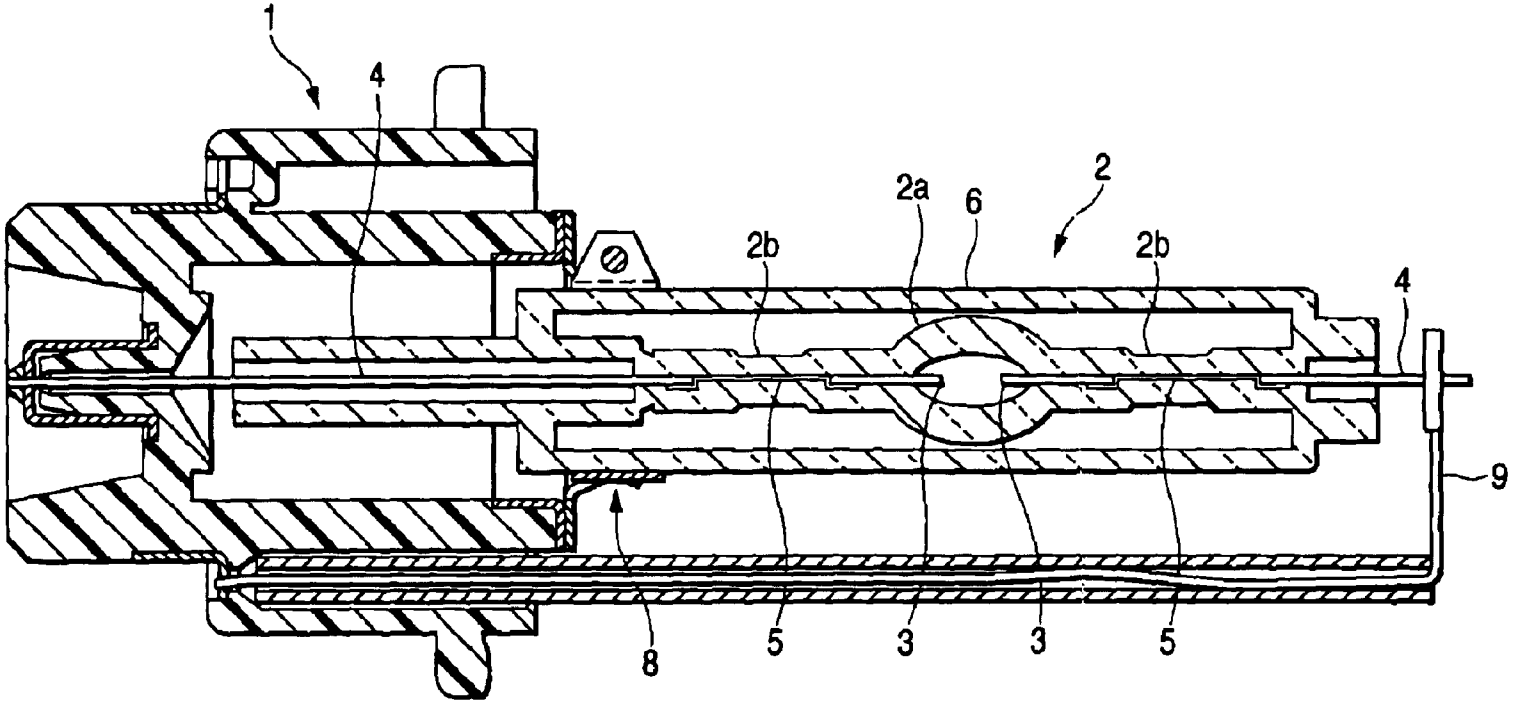
FIG. 4 is a vertical sectional view of a conventional discharge lamp unit.

FIG. 3 is a vertical sectional view of a mercury-free arc tube for a discharge lamp unit showing a second embodiment of the present invention. The outward structure is completely same as that of the mercury-free arc tube according to the first embodiment.

As for the arc tube of the first embodiment, the main light emitting metal halide, the buffer metal halide and the starting rare gas are enclosed in the closed glass bulb 12. However, it is also preferable that the buffer metal halide is not enclosed in the closed glass bulb 12. That is, according to the arc tube of the second embodiment, the main light emitting metal halide and the starting rare gas (charged pressure thereof is in a range of from 8 to 20 atmospheres) are enclosed in the closed glass bulb 12. In addition, the closed glass bulb 12 has a structure such that an inert gas with a pressure not higher than 1 atmosphere (0.5 atmosphere) is further enclosed in the closed space surrounding the arc tube body 11.

As the main light emitting metal halide enclosed in the closed glass bulb 12, NaI and $ScI_3$ are enclosed as in the case of the first embodiment. However, the total amount thereof is 0.1 mg, which is less than that (0.3 mg) of the first embodiment. Further, the ratio of NaI to $ScI_3$ is NaI:$SCI_3$= 75:25 (wt %); therefore, the ratio of NaI is large (the ratio of $ScI_3$ is small) compared with the first embodiment (NaI:$ScI_3$=70:30 (wt %)). Moreover, the charged pressure of Xe gas as the starting rare gas is 12 atmospheres, which are higher than that (10 atmospheres) of the first embodiment.

As described above, since the enclosing amount and ratio of the main light emitting metal halide (NaI and $ScI_3$) enclosed in the closed glass bulb 12 and the charged pressure of the starting rare gas (Xe gas) are adjusted, the first problem (reduction of tube voltage), the second problem (rising edge of luminous flux), third problem (reduction in luminous flux) and the fourth problem (color of emitted light) are improved.

In addition, even though the repeated descriptions are omitted by designating the same reference numerals and signs, the arc tube according to the present invention has the same structure as that of the first embodiment. Hence, the inside of the closed glass bulb 12 is narrowed in the direction of the radius thereof so that the curvature of the inner circumferential surface of the closed glass bulb 12 surrounding the inter-electrode region in which an arc is generated is reduced. In accordance with this reduction, the curvature of the arc is reduced and the arc size is reduced. As a result, since luminous intensity distribution control of the arc can be made easily, the fifth problem (curvature of arc) is also improved.

Further, according to the second embodiment, a ratio (D2/D1) of an inner diameter D2 (mm) at a position near a tip end portion of the electrode to an inner diameter D1 (mm) at a position in the middle of the electrodes of the closed glass bulb 12 is set in a range of from 0.5 to 1.1. As a result, it is confirmed that the correlations shown in FIG. 2 are satisfied. That is, the appropriate shape of the arc, the stability of the discharge, the avoidance of devitrification and the appropriate re-firing voltage in the closed glass bulb are satisfied. Moreover, according to the mercury-free arc tubes of the second embodiment, which are used for the experiments shown in FIG. 2, the tube voltage is 42V, the luminous flux is 3,200 lumen, the chromaticity x is 0.395 and the chromaticity y is 0.400. Hence, the characteristics (tube voltage, luminous flux, chromaticity) close to those of the conventional mercury-containing arc tubes are obtained.

Further, according to the first embodiment, since the main light emitting metal halide, the buffer metal halide and the starting rare gas are enclosed in the closed glass bulb 12, desirable characteristics can be obtained by adjusting the enclosing amount and ratio thereof and the charged pressure of the rare gas. Hence, desirable characteristics can be selected from many alternatives. On the other hand, according to the second embodiment, since the buffer metal halide is not enclosed in the closed glass bulb as in the case of the first embodiment, desirable characteristics should be selected from less alternatives compared with the first embodiment. However, the arc tube can be provided at a lower cost.

As is obvious from the above description, in accordance with the mercury-free arc tube for a discharge lamp unit of the first aspect of the invention, there can be provided a mercury-free arc tube which has characteristics approaching the characteristics of a conventional mercury-containing arc tube and is less harmful to the environment by a very simple structure in which the main light emitting metal halide is enclosed in a closed glass bulb while the charged pressure of starting rare gas enclosed in the closed glass bulb is made high.

Further, in accordance with the mercury-free arc tube for a discharge lamp unit of the second aspect of the invention, there can be provided a mercury-free arc tube which has characteristics approaching the characteristics of a conventional mercury-containing arc tube and is less harmful to the environment by a very simple structure in which the buffer metal halide substituted for mercury is enclosed, together with the main light emitting metal halide, in a closed glass bulb while the charged pressure of starting rare gas enclosed in the closed glass bulb is made high.

Moreover, according to the third aspect of the invention, there can be provided a mercury-free arc tube which satisfies all conditions relating to an appropriate shape of arc, stability of discharge, avoidance of devitrification and an appropriate re-firing voltage in a closed glass bulb by forming an inner circumferential surface of the closed glass bulb into a predetermined shape.

According to the fourth aspect of the invention, a mercury-free arc tube having characteristics approaching the characteristics of a conventional mercury-containing arc tube can be produced by having a shape and dimensions the same as those of the conventional mercury-containing arc tube or only by slimming a closed glass bulb. Hence, the production cost becomes low.

According to the fifth aspect of the invention, a mercury-free arc tube having characteristics approaching the characteristics of a conventional mercury-containing arc tube can be obtained by the heat insulating function of a closed space (inert gas layer with a pressure of not higher than 1 atmosphere) surrounding a closed glass bulb.

What is claimed is:

1. A mercury-free arc tube for a discharge lamp unit comprising:

a closed glass bulb held between pinch seal portions located at opposite ends of said closed glass bulb; and a pair of electrodes provided in said closed glass bulb so as to be opposite to each other, wherein a main light emitting metal halide and a starting rare gas are enclosed in said closed glass bulb, wherein a charged pressure of said starting rare gas is set to be in a range of from 8 to 20 atmospheres, and wherein a ratio (D2/D1) of an inner diameter (D2) at a position near a tip end portion of said electrode to an inner diameter D1 at a position in a middle of said pair of electrodes is in a range of from 0.5 to 1.1.

2. The mercury-free arc tube according to claim 1, wherein a buffer metal halide is enclosed in said closed glass bulb.

3. The mercury-free arc tube according to claim 1, wherein the ratio (D2/D1) is in a range of from 0.6 to 1.0.

4. The mercury-free arc tube according to claim 1, wherein said closed glass bulb has a maximum inner diameter in a range of from 2.0 to 3.5 mm.

5. The mercury-free arc tube according to claim 4, wherein a length of protrusion of said electrode into said closed glass bulb is in a range of from 1.0 to 2.0 mm.

6. The mercury-free arc tube according to claim 5, wherein a distance between said pair of electrodes is in a range of from 4.0 to 4.4 mm.

7. The mercury-free arc tube according to claim 4, wherein a quantity of enclosure of said main light emitting metal halide is in a range of from 0.1 to 0.6 mg.

8. The mercury-free arc tube according to claim 1, wherein a cylindrical shroud glass is integrally welded to said arc tube to thereby form a closed space surrounding said closed glass bulb, and an inert gas with a pressure not higher than 1 atmosphere is enclosed in said closed space.

9. A mercury-free arc tube for a discharge lamp unit comprising:

a closed glass bulb held between pinch seal portions located at opposite ends of said closed glass bulb; and a pair of electrodes provided in said closed glass bulb so as to be opposite to each other, wherein a main light emitting metal halide and a starting rare gas are enclosed in said closed glass bulb, wherein a charged pressure of said starting rare gas is set to be in a range of from 8 to 20 atmospheres, wherein a ratio (D2/D1) of an inner diameter (11)2) at a position near a tip end portion of said electrode to an inner diameter D1 at a position in a middle of said pair of electrodes is in a range of from 0.5 to 1.1, and wherein a distance between said pair of electrodes is in a range of from 4.0 to 4.4 mm.

* * * * *